US006537102B1

(12) United States Patent
Lin

(10) Patent No.: US 6,537,102 B1
(45) Date of Patent: Mar. 25, 2003

(54) ADAPTER FOR SUSPENDING FROM STRINGS OF CHRISTMAS LIGHTS

(76) Inventor: Mei-Lu Lin, P.O. Box 697, Feng-Yuan City 420 (TW)

( * ) Notice: Subject to any disclaimer, the term of this patent is extended or adjusted under 35 U.S.C. 154(b) by 0 days.

(21) Appl. No.: 10/047,409

(22) Filed: Jan. 16, 2002

(51) Int. Cl.[7] ..... H01R 4/24
(52) U.S. Cl. ..... 439/425; 439/419
(58) Field of Search ..... 439/505, 417, 439/418, 425, 419

(56) References Cited

U.S. PATENT DOCUMENTS 5,366,386 A * 11/1994 Liao ..... 439/425
5,964,613 A * 10/1999 Huang ..... 439/419
6,086,410 A * 7/2000 Lin ..... 439/425

* cited by examiner

*Primary Examiner*—Gary Paumen
(74) *Attorney, Agent, or Firm*—Mei-Lu Lin

(57) ABSTRACT

An adapter for suspending from the strings of Christmas lights includes an adapter having a longitudinal groove in cooperation with a pair of arcuate slots for disposing an electric power wire and a pair of transverse flanges for coupling a pair of coupling plates on a press box in a snap fitting. The press box has a pair of contact plates connected to one end of a pair of subordinate electric wires which has other ends extending downward from the bottom of the press box to further connect the strings of Christmas lights in a pattern plate. The contact plates each has a pair of tip points on the top to respectively pierce into the electric power wire to obtain the electricity in order to light the strings of the Christmas lights.

3 Claims, 4 Drawing Sheets

ADAPTER FOR SUSPENDING FROM STRINGS OF CHRISTMAS LIGHTS

BACKGROUND OF THE INVENTION

The present invention relates to Christmas lights and more particularly to an adapter for suspending from the strings of Christmas lights.

It is known that the strings of Christmas lights are usually attached to a pine tree or other objects in order to make them more beautiful and brilliant. Since the strings of Christmas lights can not make a shape itselves, some of the producers use a plate to which the strings of Christmas lights are attached to make different shapes of patterns or that the strings of Christmas lights dispose in a lantern and/or onto a variety of shaped objects. Because several strings of Christmas lights need several pieces of electric wires and plugs, it becomes very complicated to arrange the supply of the power sources. Besides, it is impossible to hang the plate with the strings of Christmas lights from a thingwithout supplying the electricity.

SUMMARY OF THE PRESENT INVENTION

The present invention has a main object to provide a adapter for suspending from the strings of Christmas lights which the adapter depend on an electric power wire and the pattern of Christmas lights suspends from the adapter through a pair of subordinate electric wires to obtain the electricity from the electric power wire to lighten the strings of Christmas lights on a plate of pattern.

Accordingly, the adapter for suspending from the strings of Christmas lights of the present invention comprises generally an adapter or several adapters depend on an electric power wire, a press box having a pair of contact plates therein and each of the contact plates connects a subordinate electric wire from which the pattern of strings of Christmas lights is suspended. When the press box couples with the adapter, the tips of the contact plates pierce into the electric power wire to obtain the electric power to lighten the strings of Christmas lights on the plate of pattern.

The present invention will become more fully understood by reference to the following detailed description thereof when read in conjunction with the attached drawings.

DETAILED DESCRIPTION OF THE PREFERRED EMBODIMENT

With reference to FIGS. 1 to 5 of the drawings, the adapter for suspending from the strings of Christmas lights of the present invention comprises an adapter 10, a press box 20 and an electric power wire 30.

Figure 4:
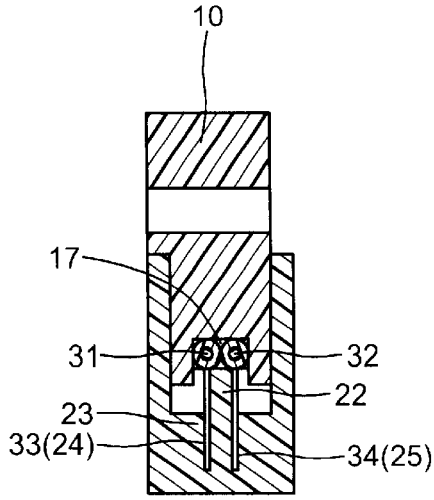
FIG. 4 is a cross sectional view of FIG. 2.

The adapter 10 has an arcuate top 12, a flat bottom 13, a pair of arcuate slots 11 symmetrically formed in two ends, a pair of through holes 14 spacedly formed in the curved corners of the arcuate slots 11, a through hole 15 in a center of the adapter 10 reinforced by ribs 18, a pair of transverse flanges 16 having beveled underside on an outer surface of a pair of vertical walls adjacent two ends abutting the arcuate slots 11 and a longitudinal groove 17 centrally formed under the flat bottom 13 along the length thereof (as shown in FIG. 4).

The electric power wire 30 includes a first and a second wires 31 and 32 juxtaposedly disposed into the longitudinal groove 17 of the adapter 10 having their two ends respectively passing through the arcuate slots 11 of the adapter 10. The electric power wire 30 has predetermined length and having one end connected to an external power source.

Figure 5:
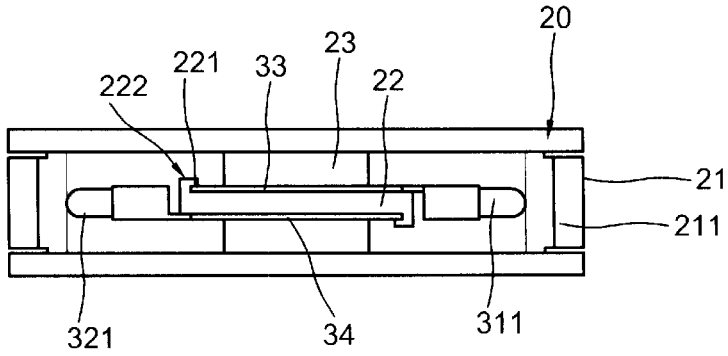
FIG. 5 is a top view to show the press box.

The press box 20 has a hollow rectangular body, an opening 26 in the top, a pair of vertical slits 212 in each of the lateral walls, a pair of coupling plates 211 having beveled top symmetrically formed on the upper inner side of the lateral walls 21 engageable with the transverse flanges 16 of the adapter 10, a projection plate 22 centrally projected upward from the inner surface of the bottom including a pair of L-shaped check blocks 221 symmetrically formed at two ends to define a pair of guide slits 222 therebetween, a pair of extensions 23 symmetrically extending inward from a central inner sides of the front and back walls to define a pair of positioning gaps between with the projection plate 22 and themselves (as shown in FIG. 5) and a pair of circular through holes 241 and 251 spacedly formed in the bottom of the press box 20 abutting the lateral walls 21 thereof.

A pair of contact plates 33 and 34 dispose into the positioning gaps of the press box 20 respectively with their front ends respectively engaged into the guide slits 222. The contact plates 33 and 34 each has a pair of tip points 331 and 341 spacedly formed on the top and a rear end connected a subordinate electric wire 311 and 321 respectively. The subordinate electric wires 311 and 321 extend downward through the circular through holes 241 and 251 of the box 20 and then connect to the strings of Christmas lights 41 in a hexagon pattern plate 40.

Figure 1:
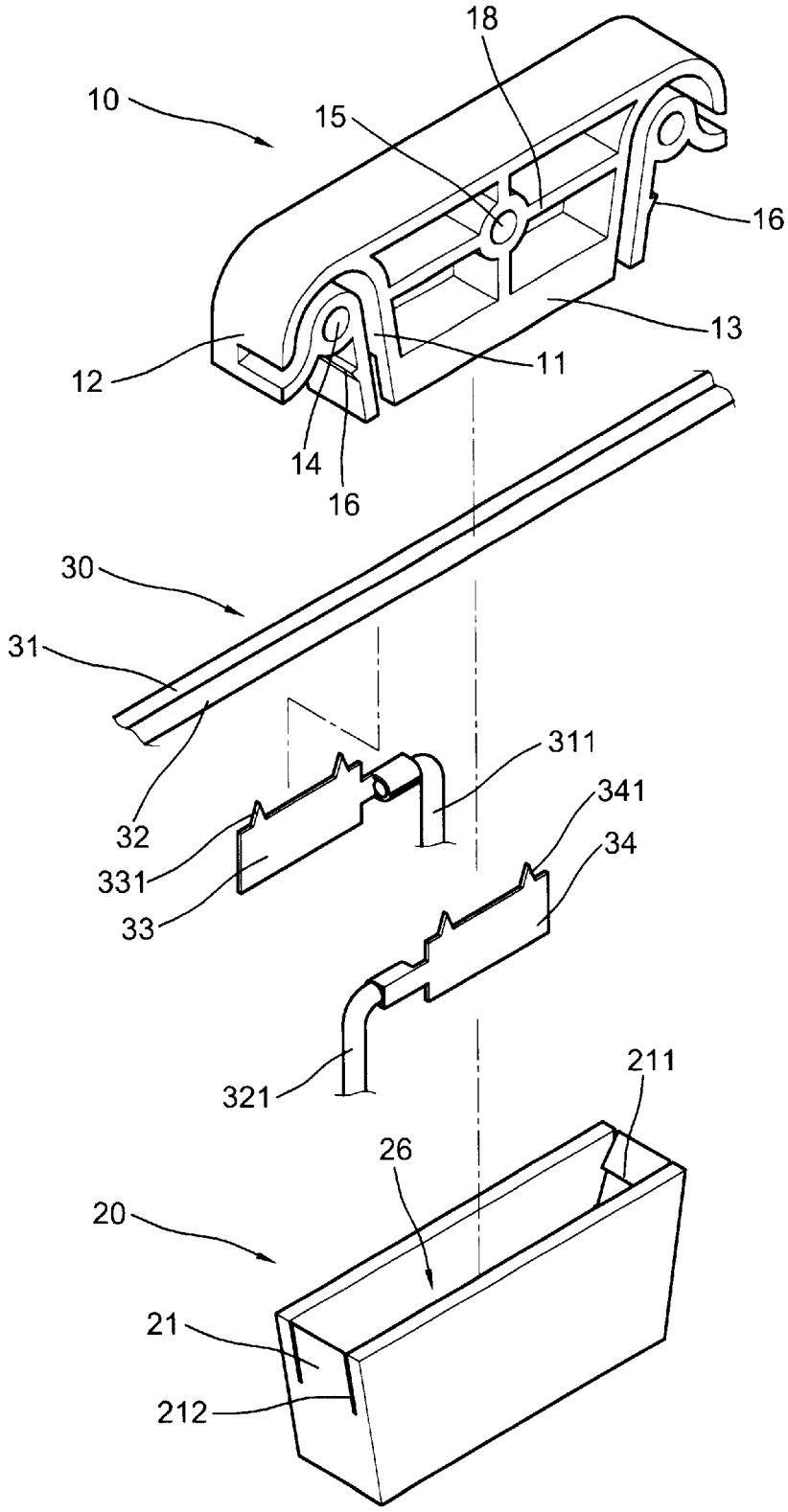
FIG. 1 is an exploded perspective view to show the preferred embodiment of the present invention.
Figure 2:
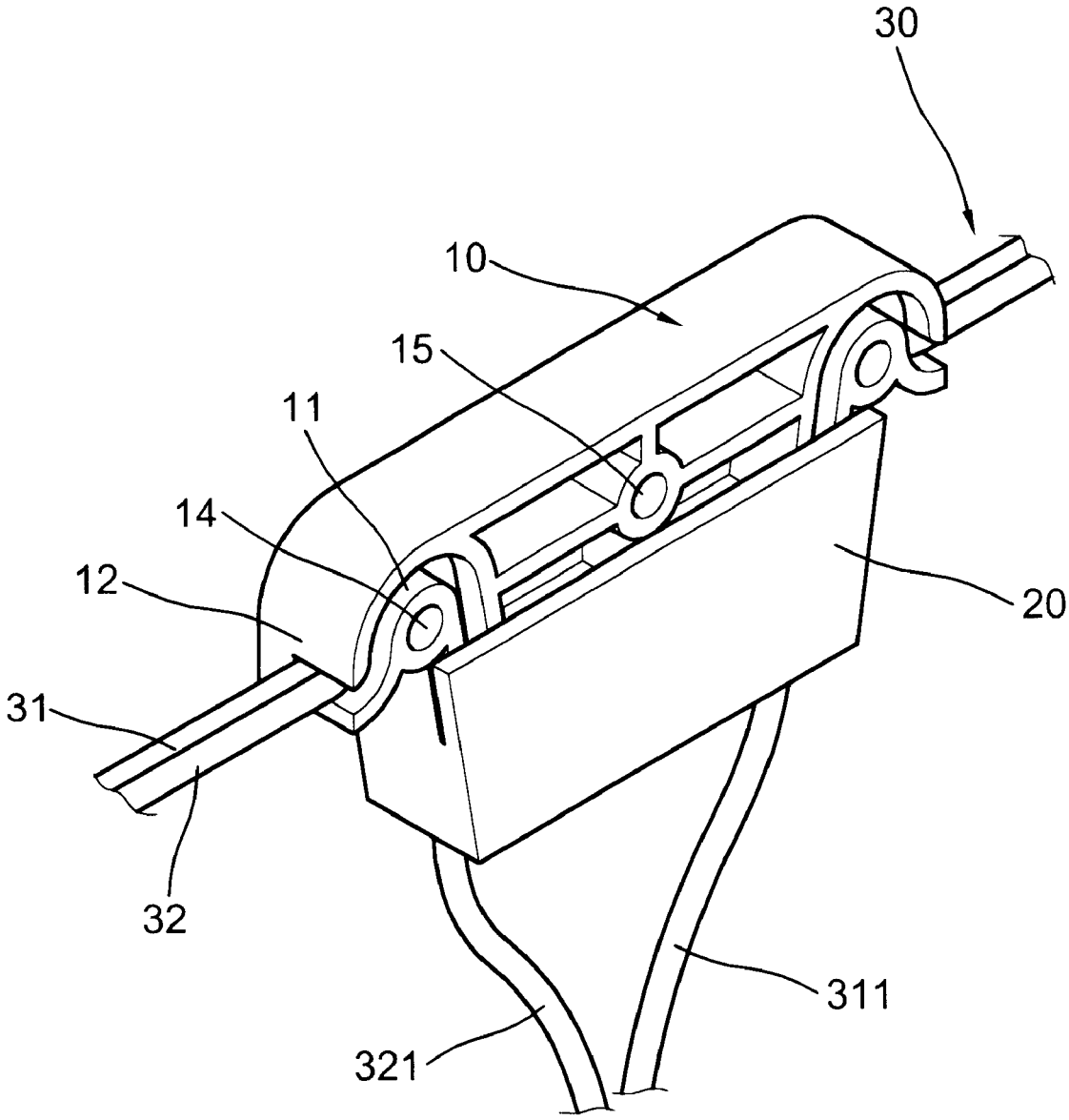
FIG. 2 is a perspective view to show the assembly of FIG. 1.
Figure 3:
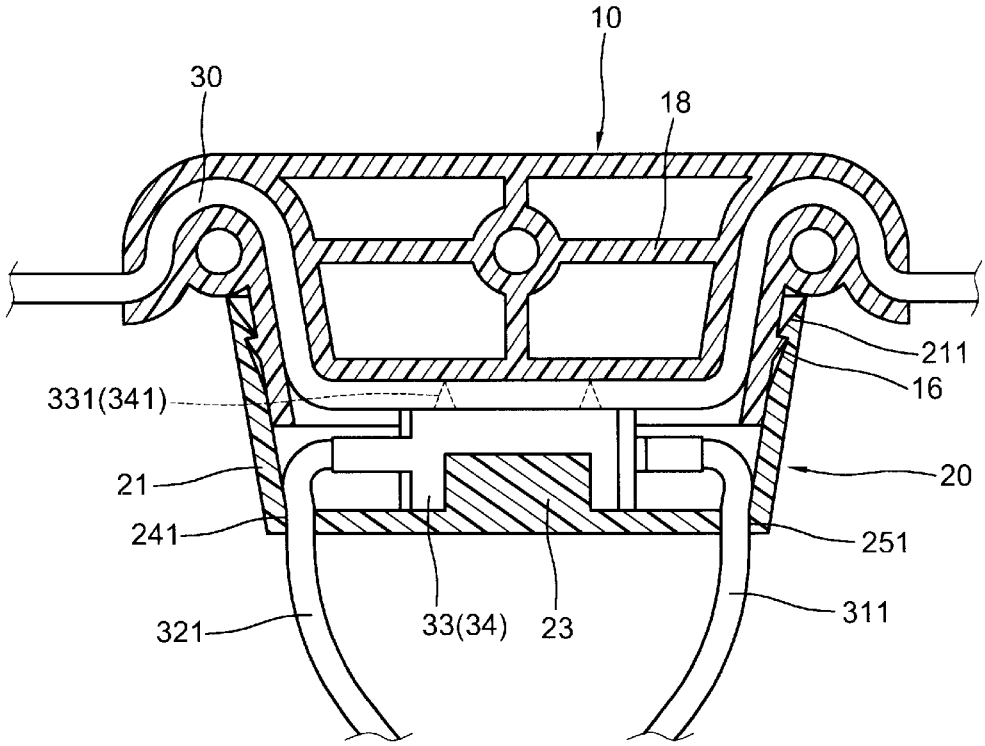
FIG. 3 is a longitudinal sectional view of FIG. 2.
Figure 6:
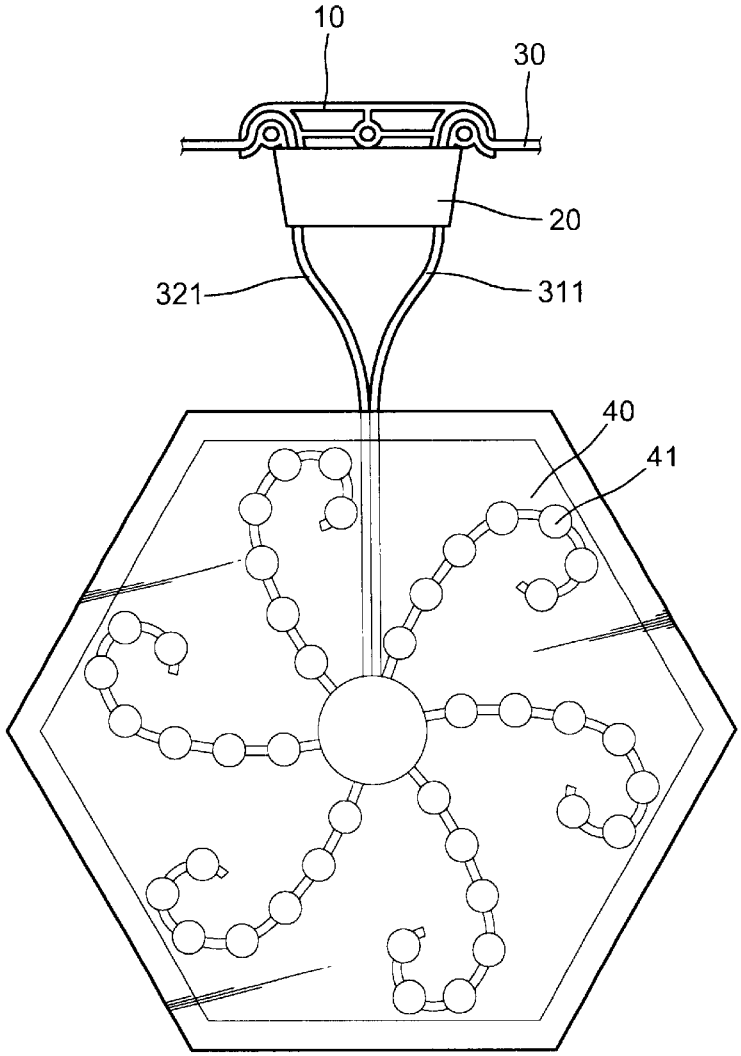
FIG. 6 is an elevational view to show a pattern of the strings of Christmas lights suspending from the adapter.

When pressedly couple the press box 20 with the bottom 13 of the adapter 10, the coupling plates 211 of the press box 20 will be engaged with the transverse flanges 16 of the adapter 10 in a snap fitting and the tip points 331 and 341 of the contact plates 33 and 34 will be pierced into the wires 31 and 32 respectively to obtain electricity to lighten the strings of Christmas lights 41 in the pattern 40 (as shown in FIGS. 3, 4 and 6). Therefore, the pattern 40 with the glittering Christmas lights 41 is suspended from the adapter 10. If the pattern 40 is too heavy to get the adapter 10 to fall down, a rope can be used to bind the through holes 14 or 15 to hang the adapter 10 from a higher place. Further the lateral walls 21 of the press box 20 is elastic so that the assembly or disassembly of the press box 20 to the adapter 10 is very convenient.

Actually the electric power wire 30 may be longer and the pattern 40 may be plural to include different shapes in order to make it more beautiful and brilliant.

Note that the specification relating to the above embodiment should be construed as exemplary rather than as limitative of the present invention, with many variations and modifications being readily attainable by aperson of average skill in the art without departing from the spirit or scope thereof as defined by the appended claims and their legal equivalents.

I claim:

1. An adapter for suspending from strings of Christmas lights comprising:

an adapter having an arcuate top, a flat bottom, a pair of arcuate slots symmetrically formed in two ends thereof, a pair of first through holes spacedly formed in curved corners of the arcuate slots, a second through hole in a center of the adapter reinforced by a plurality of ribs, a pair of transverse flanges having beveled underside on an outer surface of a pair of vertical walls adjacent two end thereof abutting the arcuate slots and a longitudinal groove centrally formed under the bottom along the length thereof;

an electric power wire which is combined by a first and a second wires juxtaposedly disposed into the longitudinal groove of said adapter having their two ends passing through the arcuate slots of the adapter respectively, said electric power wire having predetermined length with one end connected to an external power source;

a press box pressedly coupled with the bottom of said adapter in a snap fitting, said press box having a hollow rectangular body, an opening in top, a pair of vertical slits in each of lateral walls of said press box, a pair of coupling plates having beveled top symmetrically formed on an upper inner side of each of the lateral walls engageable with the transverse flanges of said adapter, a projection plate centrally projected upward from an inner side of bottom of said press box including a pair L-shaped check blocks symmetrically formed at two ends to define a pair of guide slits therebetween, a pair of extensions symmetrically extended inward from a central inner side of front and back walls of said press box to form a pair of positioning gaps between the projection plate and themselves and a pair of circular through holes spacedly formed in the bottom of said press box abutting the lateral walls thereof;

a pair of contact plates respectively disposed into the pair of positioning gaps in said press box having their front ends engaged into the guide slits and their rear ends respectively connected to a pair subordinate electric wires which extend downward through the pair of circular through holes in the bottom of said press box respectively and then connected to strings of Christmas lights in a hexagon pattern plate, said contact plates each further having a pair of tip points on top to respectively pierce into the first and second power wires of said electric power wire in the adapter to obtain electricity to lighten the strings of Christmas lights in the hexagon pattern plate.

2. The adapter as recited in claim 1 wherein said adapter may be plural.

3. The adapter as recited in claim 1 wherein said lateral walls of said press box is elastic to facilitate the press box to couple with the adapter in a snap fitting.

* * * * *